United States Patent [19]

Breckenfeld et al.

[11] Patent Number: 4,599,979

[45] Date of Patent: Jul. 15, 1986

[54] UPPER CRANKSHAFT BEARING LUBRICATION SYSTEM FOR TWO-CYCLE ENGINE

[75] Inventors: Paul W. Breckenfeld, Winthrop Habor; George L. Broughton, Waukegan; David C. Calamia, Grays Lake; James E. Macier, Waukegan, all of Ill.

[73] Assignee: Outboard Marine Corporation, Waukegan, Ill.

[21] Appl. No.: 639,949

[22] Filed: Aug. 9, 1984

[51] Int. Cl.[4] ..... F02B 33/06; F01M 3/00

[52] U.S. Cl. ..... 123/73 AD; 123/196 W; 184/6.28

[58] Field of Search ..... 123/73 AD, 59 B, 73 B, 123/196 W; 184/6.28, 15 R; 418/100

[56] References Cited

U.S. PATENT DOCUMENTS

| | | | |
|---|---|---|---|
| 1,606,424 | 11/1926 | Irgens et al. | 123/73 AD |
| 2,128,065 | 8/1938 | Aikman | 184/6 |
| 2,333,524 | 11/1943 | Conouer | 123/196 W |
| 2,936,748 | 5/1960 | Jensen | 123/196 |
| 2,959,164 | 11/1960 | Janeway et al. | 123/73 |
| 2,983,334 | 5/1961 | Dalrymple | 184/6 |
| 3,132,635 | 5/1964 | Heidner | 123/74 |
| 3,523,592 | 7/1968 | Fenton | 184/6 |
| 3,730,149 | 5/1973 | Brown | 123/73 |
| 3,805,751 | 4/1974 | Resnick et al. | 123/73 |
| 3,811,806 | 5/1974 | King | 418/100 |
| 3,859,967 | 1/1975 | Turner et al. | 123/73 |
| 3,911,870 | 10/1975 | Hackbarth | 123/8.01 |
| 3,929,111 | 12/1975 | Turner et al. | 123/73 |
| 4,121,551 | 10/1978 | Turner | 123/59 |
| 4,345,551 | 8/1982 | Bloemers | 123/59 B |
| 4,381,741 | 5/1983 | Walsworth | 123/73 AD |
| 4,383,504 | 5/1983 | Walsworth | 123/73 AD |
| 4,471,728 | 9/1984 | Borst | 123/73 AD |
| 4,473,340 | 9/1984 | Walsworth | 123/73 AD |

*Primary Examiner*—Carl Stuart Miller

*Attorney, Agent, or Firm*—Michael, Best & Friedrich

[57] ABSTRACT

The two-cycle internal combustion engine has a sump in a lower portion of the crankcase for collecting engine fuel drains and a crankshaft bearing lubrication system including a first conduit means connecting the upper crankshaft bearing in communication with the engine intake manifold, second conduit means connecting the upper crankshaft bearing in liquid communication with the sump and having an intermediate portion or reservoir, and third conduit means connecting the crankcase in communication with the reservoir. A first check valve located between the sump and the reservoir permits fuel drains to flow from the sump upwardly toward the upper crankshaft bearing in response to a suction created in response to the low pressure or vacuum in the intake manifold and prevents backflow from the reservoir to the sump. A second check valve located between the crankcase and the reservoir permits flow from the crankcase into the reservoir to pump drains from the reservoir to the upper crankshaft bearing when a high pressure condition exists in the crankcase and for preventing backflow from the reservoir to the crankcase when a low pressure exists in the crankcase.

7 Claims, 2 Drawing Figures

UPPER CRANKSHAFT BEARING LUBRICATION SYSTEM FOR TWO-CYCLE ENGINE

BACKGROUND OF THE INVENTION

The invention relates to two-cycle internal combustion engines and, more particularly, to crankcase scavenged, two-cycle internal combustion engines which include a generally vertically extending crankshaft and employ engine drains to lubricate crankshaft bearings.

In crankcase scavenged, two-cycle internal combustion engines, a mixture of fuel and lubricate or so-called engine "drains" accumulating in one or more low points or sumps in the crankcase commonly are employed to lubricate the crankshaft bearings. The "drains" typically are transferred from the low point(s) or sump(s) to the upper crankshaft bearing by a suction action created by the engine intake manifold vacuum. For engines having lower intake manifold vacuums and/or "taller" crankcases, the intake manifold vacuum may not be sufficient to overcome the head between the sump and upper and provide adequate upward flow of the "drains" to the upper bearing during all engine operating conditions.

Attention is directed to the following United States patents relating to internal combustion engines including systems for recylcing "drains":

| Patentee | Pat. No. | Issue Date |
|---|---|---|
| Irgens st al. | 1,606,424 | November 9, 1926 |
| Aikman | 2,128,065 | August 23, 1938 |
| Jensen | 2,936,748 | May 17,1960 |
| Janeway et al. | 2,959,164 | November 8, 1960 |
| Dalrymple | 2,983,334 | May 9, 1961 |
| Heidner | 3,132,635 | May 12, 1964 |
| Fenton | 3,523,592 | August 11, 1970 |
| Brown | 3,730,149 | May 1, 1973 |
| Resnick et al. | 3,805,751 | April 23, 1974 |
| King | 3,811,806 | May 21, 1974 |
| Turner et al. | 3,859,967 | January 14, 1975 |
| Hackbarth | 3,911,870 | October 14, 1975 |
| Turner | 3,929,111 | December 30, 1975 |
| Turner | 4,121,551 | October 24, 1978 |

SUMMARY OF THE INVENTION

The invention provides a two-cycle internal combustion engine including a crankcase, a cylinder extending from the crankcase, a piston mounted in the cylinder for reciprocative movement to alternately create high and low pressure conditions in the crankcase, an induction passage for introducing a fuel-lubricant-air mixture into the crankcase and including a reduced pressure zone, a crankshaft having an axis which is generally verical when the engine is in a normal operating position, upper and lower bearings rotatably supporting the crankshaft in the crankcase, a sump in the crankcase in which engine fuel drains collect, first conduit means connecting the upper bearing in communication with the low pressure zone, second conduit means connecting the upper bearing in liquid communication with the sump and including an intermediate portion, third conduit means connecting the crankcase in liquid communication with the intermediate portion, first one-way valve means located between the sump and the intermediate portion for permitting fuel drains to flow from the sump upwardly toward the upper bearing in response to the low pressure condition in the low pressure zone and for preventing flow from the intermediate portion to the sump, and second one-way valve means located between the crankcase and the intermediate portion for permitting flow from the crankcase into said intermediate portion to pump fuel drains from the intermediate portion to the upper bearing when a high pressure condition exists in the crankcase and for preventing flow from the intermediate portion to the crankcase when a low pressure exists in the crankcase.

In one embodiment, the sump has an annular shape and is located adjacent the lower bearing and coaxially with the crankshaft.

In one embodiment, the cylinder includes a combustion chamber and a transfer passage connects the crankcase in communication with the combustion chamber, the crankcase includes a drains collecting area other than the sump in which drains can also collect when the engine is tilted from the normal operating position, the third conduit means is connected in liquid communication with the drains collecting area, fourth conduit means connects the third conduit means in communication with the transfer passage, and the second one-way valve means is located to permit flow from the drains collecting area through both the third and fourth conduit means when a high pressure condition exists in the crankcase and to prevent flow from the intermediate portion to the crankcase when a low pressure condition exists in the crankcase.

In one embodiment, there is provided a third one-way valve means located between the intermediate portion and the second one-way valve means for permitting flow from crankcase through the third conduit means into the intermediate portion and for preventing flow from said intermediate portion through the third and fourth conduit means.

One of the principal features of the invention is the provision of a crankcase scavenged, two-cycle, internal combustion engine including a crankshaft bearing lubrication system which effectively recycles engine drains from a lower portion of the crankcase to the upper crankshaft bearing.

Another of the principal features of the invention is the provision of such an internal combustion engine wherein the crankshaft bearing lubrication system is arranged to employ the combined effect of a suction action, created in response to a low pressure condition existing outside the crankcase, and a pumping action, created in response to the pressure variations existing in the crankcase during engine operation, for transferring the engine drains from a lower portion of the crankcase to the upper crankshaft bearing.

Still another of the principal features of the invention is the provision of an internal combustion engine described in the preceding paragraph wherein the crankcase includes a sump adjacent the lower crankshaft bearing in which drains collect when the crankshaft is generally vertical and a secondary drains collecting area in which drains can collect when the engine is tilted to a position where the crankshaft is non-vertical and which is connected in communication with the engine combustion chamber, and the lubrication system is connected in communication with both the sump and the secondary drain collecting area and includes means for preventing backflow into the crankcase and/or the combustion chamber.

Other features, aspects and advantages of the invention will become apparent to those skilled in the art upon reviewing the following detailed description, the drawing and the appended claims.

Figure 1:
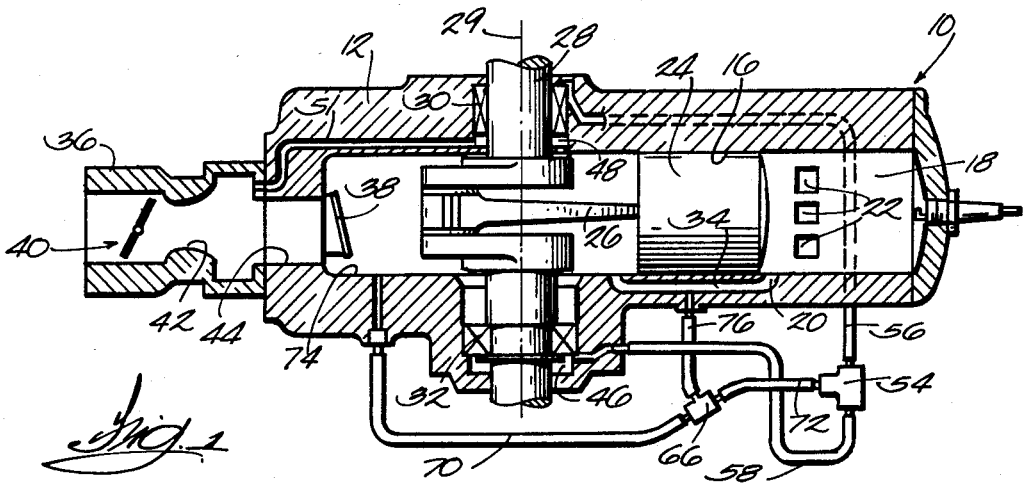
FIG. 1 is diagramatic view, partially in section, of a two-cycle internal combustion engine incorporating various of the features of the invention.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in the drawings is a crankshaft scavenged, two-cycle, internal combustion engine 10 including a crankcase 12 and a cylinder 16 extending from the crankcase 12. The cylinder 16 defines a combustion chamber 18 and has one or more inlet ports 20 and one or more exhaust ports 22 opening into the combustion chamber 18.

Mounted for reciprocative movement in the cylinder 16 is a piston 24 which is connected via a connecting rod 26 to a crankshaft 28 extending through the crankcase 12 and having a longitudinal axis 29 which is generally vertical when the engine 10 is in a normal operating position. The crankshaft 28 is supported for rotation within a crankcase 12 by an upper bearing 30 and a lower bearing 32 vertically spaced from the upper bearing 30.

The intake port(s) 20 comprises the terminus of a bypass or transfer passage 34 which communicates with the crankcase 12 and through which fuel is supplied to the combustion chamber 18 for combustion. A fuel-lubricant-air mixture is introduced into the crankcase 12 through a conventional carburetor 36 and a conventional reed valve 38 as the pressure inside the crankcase 12 decreases during the compression or upstroke of the piston 24.

The carburetor 36 has an induction passage 40 which includes a venturi 42 and has an outlet mounted in communication with an intake manifold 44 which communicates with the crankcase 12 through the reed valve 38. A low pressure or vacuum is created in the induction passage 40 downstream of the venturi 42, and thus in the intake manifold 44, in the usual manner during engine operation.

The fuel-lubricant-air mixture is periodically pumped from the crankcase 12 into the combustion chamber 18 through the transfer passage 34 when the intake port(s) 20 is open (i.e., uncovered by the piston 24) and the pressure inside the crankcase 12 increases during the expansion or downstroke of the piston 24.

Suitable means are provided in the crankcase 12 for collecting engine drains when the engine is a normal operating position, i.e., when the crankshaft axis 29 is generally vertically oriented. In the specific construction illustrated, such means comprises an annular ring or sump 46 provided in a lower portion of the crankcase 12 adjacent the lower bearing 32 and coaxially with the crankshaft 28. Drains accumulating in the sump 46 lubricate the lower bearing 32.

The crankshaft bearing lubrication system 50 provided by the invention employs a combined suction action created in response a low pressure condition existing outside the crankcase 12 and a pumping action created in response the cyclical or oscillating pressure condition existing inside the crankcase 12 to circulate drains from the sump 46 to the upper bearing 30.

In the specific construction illustrated, the suction action is created by connecting a cavity 48 adjacent the upper bearing 30 in fluid communication with the intake manifold 44 via a first conduit means or passage 51 and connecting the upper portion of the upper bearing cavity 48 in liquid communication with a lower portion of the sump 46 via a second conduit means or passage 52 including an intermediate portion or reservoir 54 into which the drains are drawn or sucked in response to the low pressure or vaccum existing in the intake manifold 44.

More specifically, the second conduit means 52 includes a hose 56 connecting the upper portion of the upper bearing cavity 48 in liquid communication with the reservoir 54 and a hose 58 connecting a lower portion of the sump 46 in liquid communication with the reservoir 54. A first one-way or check valve 60 located between the reservoir 54 and the sump 46 is operable to permit flow of drains from the sump 46 into the reservoir 54 in response to the low pressure condition existing in the intake manifold 44 and to prevent backflow from the reservoir 54 to the sump 46.

A pumping action is provided by connecting the reservoir 54 in fluid communication with the crankcase 12 via a third conduit means or passage 62 and a second one-way or check valve 64 located between the crankcase 12 and the reservoir 54. The check valve 64 is operable to permit flow from the crankcase 12 to the reservoir 54 and to prevent backflow from the reservoir 54 to the crankcase 12.

In the specific construction illustrated, the third conduit means 62 includes a T-fitting 66 and a fourth one-way or check valve 68 operable to permit flow from the crankcase 12 to the reservoir 54 and to prevent flow from the reservoir 54 toward the crankcase 12. The purpose of the T-fitting 66 and check valve 68 will be explained in more detail below. The third conduit means 62 also includes a hose 70 connected between the check valve 64 and the T-fitting 66 and a hose 72 connected between the T-fitting 66 and the check valve 68.

During engine operation, the check valves 64 and 68 open and close in response to the cyclical or oscillating pressure created in the crankcase 12. When the check valves 64 and 68 are open, a pressurized stream of the fuel-lubricant-air mixture in the crankcase 12 flows through the hose 70, the T-fitting 66 and the hose 72 into the reservoir 54 and provides a pumping action to assist the suction acting on the drains in the reservoir 54 in moving the drains upwardly through the hose 56 from the reservoir 54 to the upper bearing cavity 48. In addition to the pumping action provided by this stream, the air in the mixture tends to aerate the drains in the reservoir 54 and thereby reduce the liquid head which must be overcome to move the drains from the reservoir 54 to the upper bearing cavity 48.

The third conduit means 62 can be connected to the crankcase 12 at any suitable location where the desired cyclical pressure condition exists. In the specific construction illustrated, the check valve 64 is connected in communication with a drains collecting area 74 inside the crankcase 12, other than the sump 46, which becomes a low point where drains can also collect when the engine is tilted from the normal operating position and the crankshaft axis 29 is no longer vertical. For example, when the engine 10 is used in an outboard motor, the crankshaft axis 29 is substantially vertical during normal operation but is at an angle to the vertical when the propulsion unit is tilted to different propeller trim positions.

The third conduit means 62 is connected in liquid communication with the transfer passage 34 via a fourth conduit means in the form of a hose 76 connected to the T-fitting 66 and a fitting (not shown) opening into the transfer passage 34. Thus, when the engine 10 is tilted from the normal operating position, a portion of the drains collecting in the area 74 is pumped through the hose 70, the T-fitting 66, the hose 76, the transfer passage 34 and the intake port(s) 20 into the combustion chamber 18 for combustion. Another portion of these drains is pumped through the hose 70, the T-fitting 66, the hose 72 and the check valve 68 into the reservoir 54.

When the engine 10 is in the normal operating position, separate streams of the fuel-lubricant-air mixture in the crankcase 12, rather than drains, are pumped into the combustion chamber 18 and the reservoir 54. When the check valve 64 is closed in response to a low pressure inside the crankcase 12, the check valve 68 is also closed and prevents backflow of drains from the reservoir 54 into the transfer passage 34 which could adversely affect engine combustion.

Figure 2:
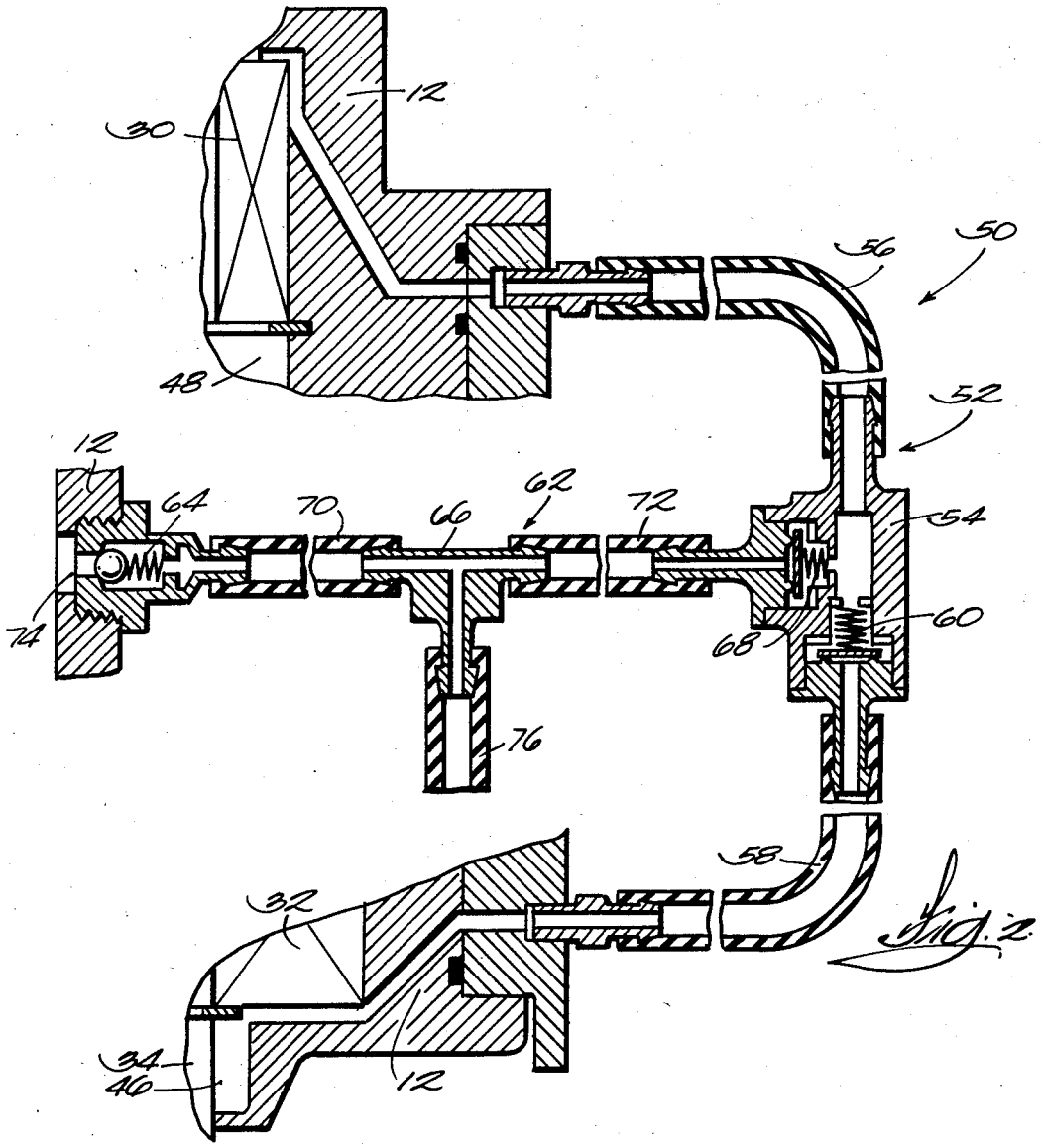
FIG. 2 is an enlarged, fragmentary view of the crankshaft bearing lubrication system in the engine illustrated in FIG. 1.

In actual practice, the reservoir 54 and the check valves 60 and 68 can be parts of a three-way check valve assembly as illustrated in FIG. 2.

Various of the features of the invention are set forth in the following claims.

We claim:

1. A two-cycle internal combustion engine including a crankcase, a cylinder extending from said crankcase, a piston mounted in said cylinder for reciprocative movement to alternatively create high and low pressure conditions in said crankcase, an induction passage for introducing a fuel-lubricant-air mixture into said crankcase and including a low pressure zone, a crankshaft having an axis which is generally vertical when said engine is in a normal operating position, upper and lower bearings rotatably supporting said crankshaft in said crankcase, a sump in said crankcase adjacent said crankshaft and in which engine fuel drains collect, first conduit means connecting said upper bearing in communication with said low pressure zone, second conduit means connecting said upper bearing in liquid communication with said sump and including an intermediate portion, third conduit means connecting said crankcase in an area in spaced relation from said sump and in liquid communication with said intermediate portion, first one-way valve means located between said sump and said intermediate portion for permitting fuel drains to flow from said sump upwardly toward said upper bearing in response to the low pressure condition in said low pressure zone and for preventing flow from said intermediate portion to said sump, and second one-way valve means located between said crankcase and said intermediate portion for permitting flow from said crankcase to said intermediate portion to pump fuel drains from said intermediate portion to said upper bearing when a high pressure condition exists in said crankcase and for preventing flow from said intermediate portion to said crankcase when a low pressure condition exists in said crankcase.

2. A two-cycle internal combustion engine according to claim 1 wherein said sump has an annular shape and is located adjacent said lower bearing and coaxially with said crankshaft.

3. A two-cycle internal combustion engine including a crankcase having a drain collecting area in which drains can collect when the engine is tilted from the normal operating position, a cylinder extending from said crankcase and including a combustion chamber, a piston mounted in said cylinder for reciprocative movement to alternately create high and low pressure conditions in said crankcase, a transfer passage communicating with said crankcase and said combustion chamber, an induction passage for introducing a fuel-lubricant-air mixture into said crankcase and including a low pressure zone, a crankshaft having an axis which is generally vertical when said engine is in a normal operating position, upper and lower bearings rotatably supporting said crankshaft in said crankcase, a sump in said crankcase in which engine fuel drains can also collect, said sump having an annular shape and being located adjacent said lower bearing and coaxially with said crankshaft, first conduit means connecting said upper bearing in communication with said low pressure zone, second conduit means connecting said upper bearing in liquid communication with said sump and including an intermediate portion, third conduit means connecting said drains collecting area of said crankcase in liquid communication with said intermediate portion, a fourth conduit means connected in communication with said third conduit means and with said transfer passage, first one-way valve means located between said sump and said intermediate portion for permitting fuel drains to flow from said sump upwardly toward said upper bearing in response to the low pressure condition in said low pressure zone and for preventing flow from said intermediate portion to said sump, and second one-way valve means located between said intermediate portion and said connection of said third and fourth conduit means so as to permit flow from said crankcase through said third and fourth conduit means to said transfer passage when a high pressure condition exists in said crankcase and for permitting flow therethrough from said crankcase into said intermediate portion to pump fuel drains from said intermediate portion to said upper bearing when a high pressure condition exists in said crankcase and for preventing flow from said intermediate portion to said crankcase when a low pressure condition exists in said crankcase.

4. A two-cycle internal combustion engine according to claim 3 including third one-way valve means located between said intermediate portion and said second one-way valve means for permitting flow from said crankcase through said third conduit means into said intermediate portion and for preventing flow from said intermediate portion through said third and fourth conduit means.

5. A two-cycle internal combustion engine including a crankcase including an area in which engine fuel drains collect, a cylinder extending from said crankcase, a piston mounted in said cylinder for reciprocative movement to alternately create high and low pressure conditions in said crankcase, a crankshaft having an axis which is generally vertical when said engine is in a normal operating position, upper and lower bearings rotatably supporting said crankshaft in said crankcase, a sump located in said crankcase in spaced relation from said crankcase area and in adjacent relation to said crankshaft and in which engine fuel drains collect, conduit means connecting said upper bearing in liquid communication with said sump and including an intermediate portion, additional conduit means connecting said crankcase area in liquid communication with said intermediate portion, first one-way valve means located between said sump and said intermediate portion for permitting fuel drains to flow from said sump to said intermediate portion and for preventing flow from said intermediate portion to said sump, and second one-way valve means located between said crankcase area and said intermediate portion for permitting flow from said crankcase area to said intermediate portion and for preventing flow from said intermediate portion to said crankcase area.

6. A two-cycle internal combustion engine including a crankcase having a drain collecting area, a cylinder extending from said crankcase, a piston mounted in said cylinder for reciprocative movement to alternately create high and low pressure conditions in said crankcase, a crankshaft located in spaced relation to said area and having an axis which is generally vertical when said engine is in a normal operating position, upper and lower bearings rotatably supporting said crankshaft in said crankcase, a sump located in said crankcase adjacent said crankshaft and in spaced relation to said area and in which engine fuel drains collect, a conduit connecting said upper bearing in liquid communication with said sump and including an intermediate portion, an additional conduit connecting said crankcase area in liquid communication with said intermediate portion, first one-way valve means located between said sump and said intermediate portion for permitting flow from said sump through said first mentioned conduit to said intermediate portion and for preventing flow from said intermediate portion to said sump, and second one-way valve means located between said crankcase area and said intermediate portion for permitting flow from said crankcase through said additional conduit to said intermediate portion and for preventing flow from said intermediate portion to said crankcase.

7. A two-cycle internal combustion engine including a crankcase having a drain collecting area in which drains can collect when the engine is tilted from the normal operating position, a cylinder extending from said crankcase and including a combustion chamber, a piston mounted in said cylinder for reciprocative movement to alternately create high and low pressure conditions in said crankcase, a transfer passage communicating between said crankcase and said combustion chamber, a crankshaft having an axis which is generally vertical when said engine is in a normal operating position, upper and lower bearings rotatably supporting said crankshaft in said crankcase, a sump located in said crankcase and in which engine fuel drains can also collect, said sump having an annular shape and being located adjacent said lower bearing, coaxially with said crankshaft, and in spaced relation to said drains collecting area, a conduit connecting said upper bearing in liquid communication with said sump and including an intermediate portion, a first additional conduit connecting said drains collecting area of said crankcase in liquid communication with said intermediate portion, a second additional conduit connected in communication with said first additional conduit and with said transfer passage, first one-way valve means located between said sump and said intermediate portion for permitting flow from said sump through said first mentioned conduit to said intermediate portion and for preventing flow from said intermediate portion to said sump, and second one-way valve means located between said intermediate portion and said connection of said first and second additional conduits for permitting flow from said crankcase through said first and second conduits to said transfer passage and for permitting flow from said crankcase into said intermediate portion and for preventing flow from said intermediate portion to said crankcase.

* * * * *